US007587027B2

(12) United States Patent
Quaas

(10) Patent No.: US 7,587,027 B2
(45) Date of Patent: Sep. 8, 2009

(54) METHOD AND APPARATUS FOR DETERMINING AND DISPLAYING X-RAY RADIATION BY A RADIOGRAPHIC DEVICE

(75) Inventor: Richard Quaas, Sharon, WI (US)

(73) Assignee: X-Cel X-Ray, Crystal Lake, IL (US)

( * ) Notice: Subject to any disclaimer, the term of this patent is extended or adjusted under 35 U.S.C. 154(b) by 0 days.

(21) Appl. No.: 11/960,345

(22) Filed: Dec. 19, 2007

(65) Prior Publication Data

US 2008/0152089 A1 Jun. 26, 2008

Related U.S. Application Data

(60) Provisional application No. 60/871,785, filed on Dec. 23, 2006.

(51) Int. Cl.
*H05G 1/34* (2006.01)
*H05G 1/32* (2006.01)

(52) U.S. Cl. ..... 378/109; 378/111

(58) Field of Classification Search ..... 378/101, 378/106–118

See application file for complete search history.

(56) References Cited

U.S. PATENT DOCUMENTS

| | | | | |
|---|---|---|---|---|
| 1,184,503 | A | 5/1916 | Alden | |
| 1,239,145 | A | 9/1917 | Wantz | |
| 1,913,695 | A | 6/1933 | Werner | |
| 2,307,612 | A | 1/1943 | Westendrop | |
| 3,801,790 | A | 4/1974 | Götzl et al. | |
| 4,166,602 | A | 9/1979 | Nilsen et al. | |
| 4,223,230 | A | 9/1980 | Waerve et al. | |
| 4,250,388 | A | 2/1981 | Janu | |
| 4,302,675 | A | 11/1981 | Wake et al. | |
| 4,326,131 | A | 4/1982 | Waerve | |
| 4,335,315 | A | 6/1982 | Waerve et al. | |
| D273,892 | S | 5/1984 | Fenne et al. | |
| 4,532,645 | A | 7/1985 | Morris | |
| 4,577,340 | A | 3/1986 | Carlson et al. | |
| 4,587,668 | A | 5/1986 | Morris | |
| 4,590,378 | A | 5/1986 | Platz | |
| D291,915 | S | 9/1987 | Davis | |
| 4,694,480 | A | 9/1987 | Skillicorn | |
| 4,752,948 | A | 6/1988 | MacMahon | |
| 4,775,994 | A | 10/1988 | Kranvogel | |
| 4,887,287 | A | 12/1989 | Cobben | |
| 4,964,151 | A | 10/1990 | Trotel | |
| 4,989,229 | A | 1/1991 | Negrelli et al. | |
| 5,081,662 | A | 1/1992 | Warden et al. | |
| 5,283,823 | A | 2/1994 | Morris | |
| 5,388,139 | A * | 2/1995 | Beland | 378/112 |

(Continued)

*Primary Examiner*—Irakli Kiknadze
(74) *Attorney, Agent, or Firm*—Miller, Matthias & Hull

(57) ABSTRACT

Methods for determining and displaying x-ray radiation generated by a radiographic device may include storing in a memory a plurality of tables that correlate voltage and current values of an x-ray tube to a predicted radiation rate for a given radiographic device. Actual or approximate voltage and current values are then obtained from an operating x-ray tube. Based on these values, a predicted instant (or "dynamic") radiation late is selected from one of the stored tables and is displayed to the practitioner. In addition, the method may approximate an accumulated radiation dose by measuring the time periods over which predicted radiation rates are generated and calculating a running total. Apparatus for conducting such methods is also disclosed.

13 Claims, 4 Drawing Sheets

U.S. PATENT DOCUMENTS 5,388,142 A 2/1995 Morris
6,496,563 B1 * 12/2002 Bacon ..... 378/101
6,863,439 B2 3/2005 Morris
7,023,960 B2 * 4/2006 Chretien ..... 378/109
7,151,818 B1 * 12/2006 Hanington et al. ..... 378/104

* cited by examiner

FIG. 2

| "KV" | KV LOOKUP TABLE | 1 MA | 1.5 MA | 2.0 MA | 2.5 MA | 3.0 MA | R PER SECOND | R PER 5 MINS. | 35% ERROR | 5 MINS MINUS 35% ERROR | 5 MINS PLUS 35% ERROR |
|---|---|---|---|---|---|---|---|---|---|---|---|
| 40 | 0.1975 | 0.0658 | 0.0988 | 0.1317 | 0.1646 | 0.1975 | 0.0033 | 0.9877 | 0.3457 | 0.64 | 1.33 |
| 42 | 0.2178 | 0.0726 | 0.1089 | 0.1452 | 0.1815 | 0.2178 | 0.0036 | 1.0889 | 0.3811 | 0.71 | 1.47 |
| 44 | 0.2390 | 0.0797 | 0.1195 | 0.1593 | 0.1992 | 0.2390 | 0.0040 | 1.1951 | 0.4183 | 0.78 | 1.61 |
| 46 | 0.2612 | 0.0871 | 0.1306 | 0.1742 | 0.2177 | 0.2612 | 0.0044 | 1.3062 | 0.4572 | 0.85 | 1.76 |
| 48 | 0.2844 | 0.0948 | 0.1422 | 0.1896 | 0.2370 | 0.2844 | 0.0047 | 1.4222 | 0.4978 | 0.92 | 1.92 |
| 50 | 0.3086 | 0.1029 | 0.1543 | 0.2058 | 0.2572 | 0.3086 | 0.0051 | 1.5432 | 0.5401 | 1 | 2.08 |
| 52 | 0.3338 | 0.1113 | 0.1669 | 0.2226 | 0.2762 | 0.3338 | 0.0056 | 1.6691 | 0.5842 | 1.08 | 2.25 |
| 54 | 0.3600 | 0.1200 | 0.1800 | 0.2400 | 0.3000 | 0.3600 | 0.0060 | 1.8000 | 0.6300 | 1.17 | 2.43 |
| 56 | 0.3872 | 0.1291 | 0.1936 | 0.2581 | 0.3226 | 0.3872 | 0.0065 | 1.9358 | 0.6775 | 1.26 | 2.61 |
| 58 | 0.4153 | 0.1384 | 0.2077 | 0.2769 | 0.3461 | 0.4153 | 0.0069 | 2.0765 | 0.7268 | 1.35 | 2.8 |
| 60 | 0.4444 | 0.1481 | 0.2222 | 0.2963 | 0.3704 | 0.4444 | 0.0074 | 2.2222 | 0.7778 | 1.44 | 3 |
| 62 | 0.4746 | 0.1582 | 0.2373 | 0.3164 | 0.3955 | 0.4746 | 0.0079 | 2.3728 | 0.6305 | 1.54 | 3.2 |
| 64 | 0.5057 | 0.1686 | 0.2528 | 0.3371 | 0.4214 | 0.5057 | 0.0084 | 2.5284 | 0.8849 | 1.64 | 3.41 |
| 66 | 0.5378 | 0.1793 | 0.2689 | 0.3585 | 0.4481 | 0.5378 | 0.0090 | 2.6889 | 0.9411 | 1.75 | 3.63 |
| 68 | 0.5709 | 0.1903 | 0.2854 | 0.3806 | 0.4757 | 0.5709 | 0.0095 | 3.8543 | 0.9990 | 1.86 | 3.85 |
| 70 | 0.6049 | 0.2016 | 0.3025 | 0.4033 | 0.5041 | 0.6049 | 0.0101 | 3.0247 | 1.0586 | 1.97 | 4.08 |
| 72 | 0.6400 | 0.2133 | 0.3200 | 0.4267 | 0.5333 | 0.6400 | 0.0107 | 3.2000 | 1.1200 | 2.08 | 4.32 |
| 74 | 0.6760 | 0.2253 | 0.3380 | 0.4507 | 0.5634 | 0.6760 | 0.0113 | 3.3802 | 1.1831 | 2.2 | 4.56 |
| 76 | 0.7131 | 0.2377 | 0.3565 | 0.4754 | 0.5942 | 0.7131 | 0.0119 | 3.5654 | 1.2479 | 2.32 | 4.81 |
| 78 | 0.7611 | 0.2504 | 0.3756 | 0.5007 | 0.6259 | 0.7511 | 0.0125 | 3.7556 | 1.3144 | 2.44 | 5.07 |
| 80 | 0.7901 | 0.2634 | 0.3951 | 0.5267 | 0.5584 | 0.7901 | 0.0132 | 3.9506 | 1.3827 | 2.57 | 5.33 |
| 82 | 0.7944 | 0.2648 | 0.3972 | 0.5296 | 0.6620 | 0.7944 | 0.0132 | 3.9721 | 1.3902 | 2.58 | 5.36 |
| 84 | 0.8711 | 0.2904 | 0.4356 | 0.5807 | 0.7259 | 0.8711 | 0.0145 | 4.3556 | 1.5244 | 2.83 | 5.88 |
| 86 | 0.9131 | 0.3044 | 0.4565 | 0.6087 | 0.7609 | 0.9131 | 0.0152 | 4.5654 | 1.5979 | 2.97 | 6.16 |
| 88 | 0.9560 | 0.3187 | 0.4780 | 0.6374 | 0.7967 | 0.9560 | 0.0159 | 4.7802 | 1.6731 | 3.11 | 6.45 |
| 90 | 0.9900 | 0.3300 | 0.4950 | 0.6600 | 0.8250 | 0.9900 | 0.0165 | 4.9500 | 1.7325 | 3.22 | 6.68 |
| 92 | 1.0449 | 0.3483 | 0.5225 | 0.6966 | 0.8708 | 1.0449 | 0.0174 | 5.2247 | 1.8286 | 3.4 | 7.05 |
| 94 | 1.0909 | 0.3636 | 0.5454 | 0.7272 | 0.9091 | 1.0909 | 0.0182 | 5.4543 | 1.9090 | 3.55 | 7.36 |
| 96 | 1.1378 | 0.3793 | 0.5689 | 0.7585 | 0.9481 | 1.1378 | 0.0190 | 5.6889 | 1.9911 | 3.7 | 7.68 |
| 98 | 1.1857 | 0.3952 | 0.5928 | 0.7905 | 0.9881 | 1.1857 | 0.0198 | 5.9284 | 2.0749 | 3.85 | 8 |
| 100 | 1.2346 | 0.4115 | 0.6173 | 0.8230 | 1.0288 | 1.2346 | 0.0206 | 6.1728 | 2.1605 | 4.01 | 8.33 |

40

METHOD AND APPARATUS FOR DETERMINING AND DISPLAYING X-RAY RADIATION BY A RADIOGRAPHIC DEVICE

CROSS-REFERENCE TO RELATED APPLICATION

This application claims the benefit of U.S. provisional patent application No. 60/871,785, filed on Dec. 23, 2006.

BACKGROUND

1. Technical Field

This disclosure generally relates to radiographic imaging systems and methods, and more particularly to methods and apparatus for determining and displaying x-ray radiation generated by radiographic devices 2. Description of the Related Art The benefits of radiographic devices and procedures to detect and diagnose medical conditions are well documented in the art. A radiographic device typically includes an x-ray tube that is positioned near a patient and a media for capturing an x-ray image. The radiographic device may include various controls that affect the characteristics of the radiation generated by the x-ray tube. Primary among these are a voltage, or kV, control that affects how far the radiation penetrates the target, and a current, or mA, control that affects the number of photons produced by the tube that are ultimately directed toward the target area. Various types of image media are also known A fluoroscope, for example, uses a fluorescent screen to record the x-ray image. Unfortunately, as is also well known, overexposure to x-ray radiation may adversely affect one's health. Accordingly, practitioners attempt to limit or minimize exposure to x-ray radiation by using the lowest voltage and current settings necessary to capture the desired image.

The United States Food and Drug Administration (FDA) has developed regulations that limit the amount of x-ray radiation generated during radiograph procedures, thereby to protect patients from over exposure. Those regulations were recently amended to requite certain radiographic devices to display the x-ray radiation rate generated during a procedure and an accumulated radiation dosage generated over the course of a procedure. For example, under 21 CFR 1020.32, fluoroscopic equipment manufactured on or after Jun. 10, 2006 must display a current air kerma rate and a cumulative air kerma during and after operation of the x-ray tube. The displayed air kerma rate and cumulative air kerma values must not deviate from the actual values by more than 35%. The FDA defines "air kerma" as kerma in a given mass of air. The unit used to measure the quantity of air kerma is the Gray (Gy). For X-rays with energies less than 300 kiloelectronvolts (keV), 1 Gy=100 rad. In air, 1 Gy of absorbed dose is delivered by 114 roentgens (R) of exposure. "Kerma" is defined as the sum of the initial energies of all the charged particles liberated by uncharged ionizing particles in a material of given mass.

In view of the foregoing, it is desirable to provide an apparatus and method capable of determining and displaying both current and cumulative radiation output of a radiographic device.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 2 is an exemplary look-up table showing predicted radiation rates for given pairs of current and voltage values;

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted It should be understood, of course, that this disclosure is not limited to the particular embodiments illustrated herein.

DETAILED DESCRIPTION

This disclosure relates to methods and apparatus for determining and displaying x-ray radiation generated by a radiographic device. The exemplary methods may include storing in a memory a plurality of tables that correlate voltage and current values of an x-ray tube to a predicted radiation rate for a given radiographic device. Actual or approximate voltage and current values are then obtained from an operating x-ray tube. Based on these values, a predicted instant (or "dynamic") radiation rate is selected from one of the stored tables and is displayed to the practitioner In addition, the method may approximate an accumulated radiation dose by measuring the time periods over which predicted radiation rates are generated and calculating a running total. Apparatus for conducting such methods is also disclosed. While fluoroscope methods and apparatus are described herein, it will be appreciated that this disclosure may be embodied in other types of radiographic methods and devices.

Figure 1:
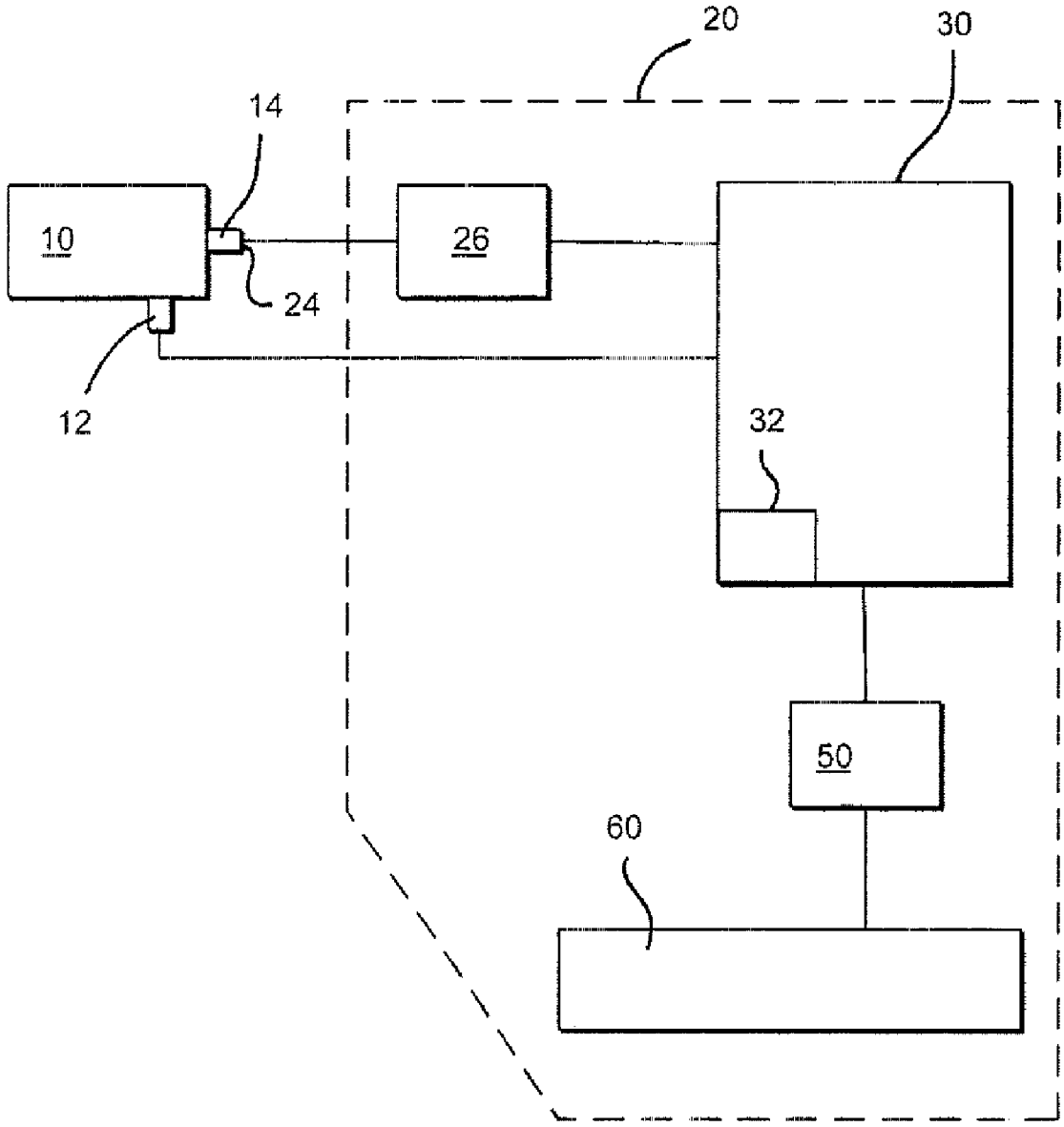
FIG. 1 is a schematic diagram of a radiation display device according to the present disclosure.

FIG. 1 illustrates exemplary apparatus 20 for determining and displaying radiation levels generated by a fluoroscope 10 The apparatus 20 receives feedback regarding the control settings, such as current and voltage, of the fluoroscope 10. The fluoroscope 10 may have a multi-position switch 12, in which each position of the switch is associated with a specific current setting In the exemplary embodiment illustrated in FIG. 5, the multi-switch 12 has five positions corresponding to five different current settings (such as 1, 1.5, 2, 2. 5, and 3 mA). The current level supplied to the fluoroscope tube may then be obtained by detecting or inferring the position of the multi-switch 12 In the illustrated embodiment five pairs of contacts 40*a-b*, 41*a-b*, 42*a-b*, 43*a-b*, and 44*a-b* are provided to determine the position of the switch. Each contact pair is associated with an intended current setting, and therefore the position of the multi-switch 12 is used to infer the actual current level supplied to the fluoroscope tube.

The mechanism for determining switch position is generally referred to herein as a "current feedback circuit." As used herein, a "current feedback circuit" encompasses any suitable method for directly sensing or approximating the current level supplied to the fluoroscope tube. The multi-switch 12 described above is one embodiment of a current sensing circuit that approximates or infers current level. Applicant has found that this approximation is sufficient to estimate radiation exposure within the 35% deviation currently allowed by the regulations. Alternatively, apparatus for directly sensing current level may be used (such as an analog/digital converter), which should be capable of generating more accurate results, if needed.

Figure 5:
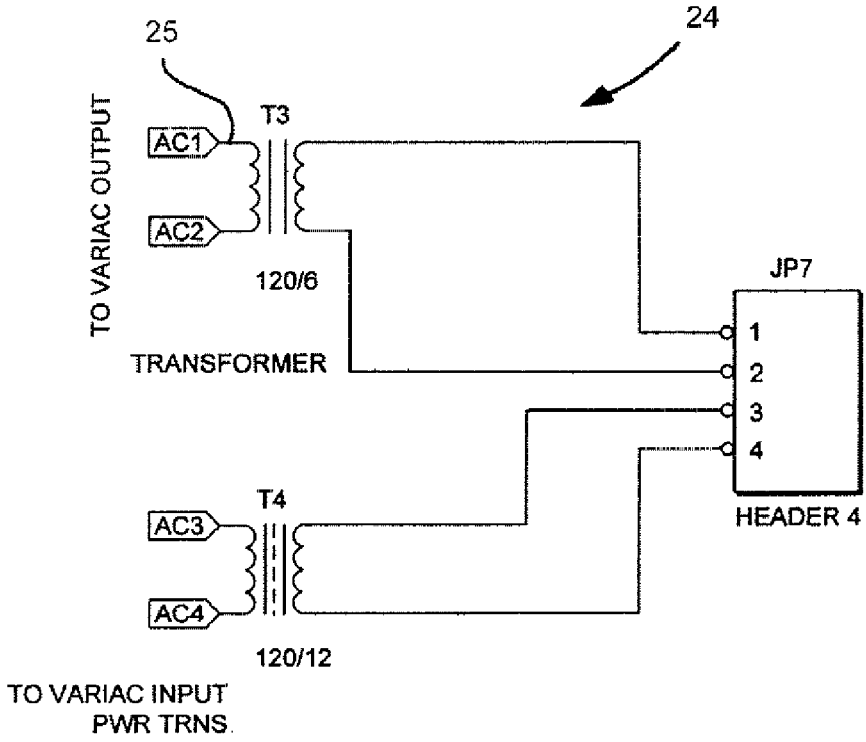
FIG. 5 is an electrical schematic illustrating a voltage sensing circuit used in the radiation device of FIG. 1

The fluoroscope 10 also includes a voltage control 14 for generating a voltage control setting. The apparatus 20 includes a voltage sensor 24 that directly measures the voltage of the voltage control signal and provides an analog voltage signal. As shown in FIG. 5, the voltage sensor 24 may be provided as a transformer 25 that directly measures the voltage level supplied to the fluoroscope tube An analog to digital converter 26 (FIG. 1) may be provided to convert the analog voltage signal to a digital voltage signal. While the exemplary embodiment directly measures voltage level using the transformer 25, it will be appreciated that other devices may be used to directly sense voltage level. Additionally, the voltage level may be inferred or approximated. As used herein, the term "voltage feedback circuit" encompasses circuits and/or devices that may directly measure voltage as well as those that infer or approximate the voltage level supplied to the fluoroscope tube.

A microprocessor 30 is provided for operating the apparatus 20. The microprocessor 30 includes inputs for receiving the current and digital voltage signals. A plurality of look-up tables is stored in a memory 32 of the processor 30 The look-up tables may be generated based on empirical data obtained by operating the particular type of x-ray tube used in the fluoroscope 10 at various operating parameters. The x-ray tube may be the actual tube used in the device or a similar tube used in a test device. The empirical data provides a predicted radiation rate for a given combination of current and voltage signals of the tube.

One exemplary chart 40 for a particular x-ray tube is shown in FIG. 2, where voltage signals "kv" are provided along an x-axis of the table and current signals "ma" are provided along the y-axis of the table. The table is filled with predicted radiation levels, which in this case are measured in Rads/minute (R/min). It will be appreciated that the current and voltage signals, as well as the predicted radiation level, may be provided in any desirable units For example, the radiation levels may be provided in milliGrays per minute (mGy/min). The chart 40 was generated by operating the subject x-ray tube at select current/voltage settings and measuring radiation output. Radiation outputs at other current/voltage settings were interpolated from the select current/voltage settings. The interpolated radiation outputs were then validated by further testing.

While the exemplary embodiment uses look-up tables based on empirical data, it will be appreciated that other means may be used to estimate radiation output. Instead of generating tables, the mathematical relationships between current/voltage levels and radiation output may be integrated into the circuit board to provide a direct estimation of radiation output. For example, it is generally known that for a constant voltage level, radiation output will vary substantially directly proportionally to changes in the current level It is also known that for a constant current level, changes in voltage will cause the radiation output to vary according to the square of the ratio of the change in voltage level. These relationships generally hold true for voltage levels in the 50-90 kV range. Accordingly, a single radiation output and its associated current and voltage settings for a tube may be stored in memory and the known mathematical relationships between voltage/current settings and radiation output may be used to directly calculate an estimated radiation output for different current/voltage levels.

Based on the current and voltage signals, and with reference to the stored look-up tables, the microprocessor 30 will determine an instant or "dynamic" radiation rate for the fluoroscope 10.

The microprocessor 30 may also determine a cumulative radiation dose in addition to the dynamic radiation rate. For example, the microprocessor 30 may include a sample loop circuit 34 that repeats after a set period of time "t" such as one second. Radiation that has accumulated during each time period "t" may then be approximated by multiplying the currently estimated radiation rate by the time period "t" to obtain a sample period accumulated radiation value. The sample loop is repeated for the duration of the x-lay tube operation to obtain subsequent sample period radiation values. The sample period radiation values are then aggregated to obtain a total accumulated radiation value that estimates the total radiation dosage administered during the radiographic procedure.

The exemplary apparatus also includes a back-up memory 50 for storing the dynamic radiation rate and the accumulated radiation value. The back-up memory 50 is preferably battery powered so that it may retain the stored values in the event of a power failure.

A display 60 is operatively coupled to the microprocessor 30 for displaying the dynamic radiation rate and the total accumulated radiation value. The display 50 may be provided as a LCD or other known output. The display 50 preferably shows the radiation units in addition to the numeric values for the radiation rates and accumulated radiation dosage determined by the microprocessor 30.

Figure 3:
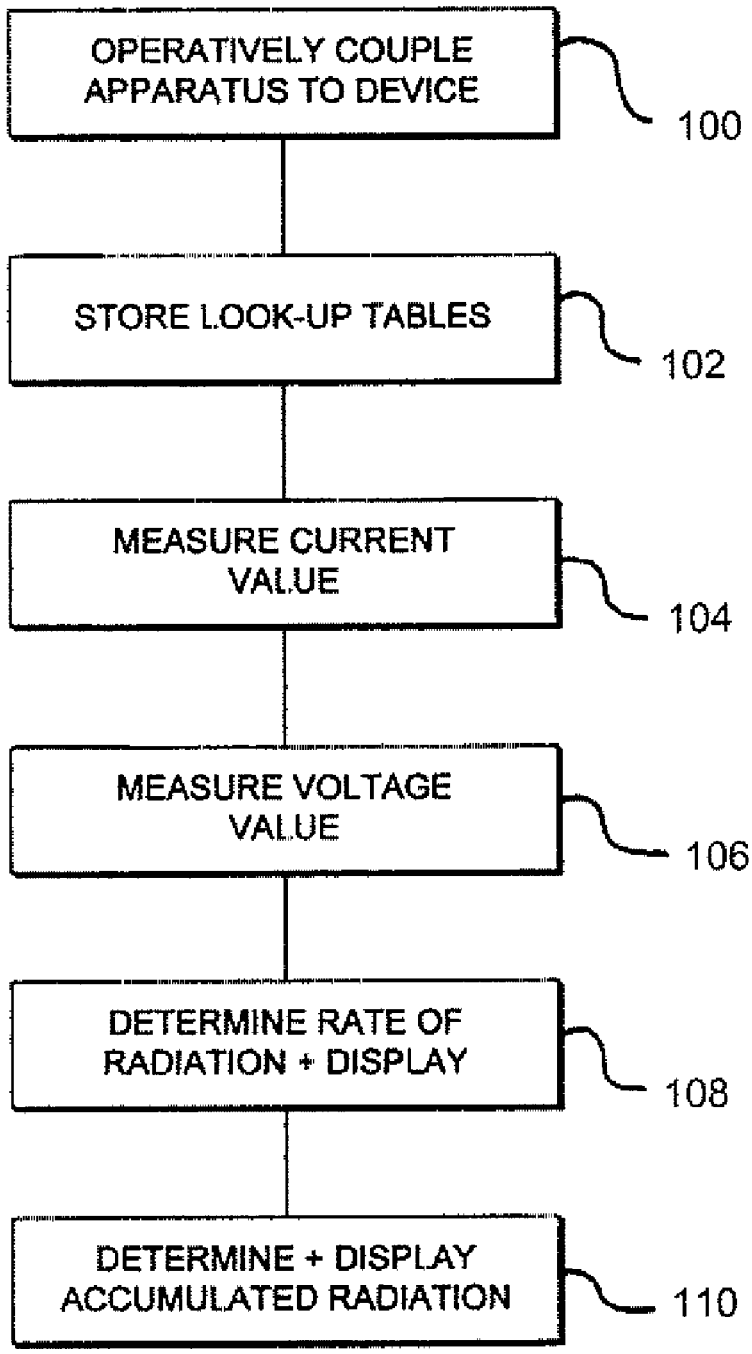
FIG. 3 is a block diagram of a method for determining and displaying radiation generating by a radiographic device.
Figure 4:
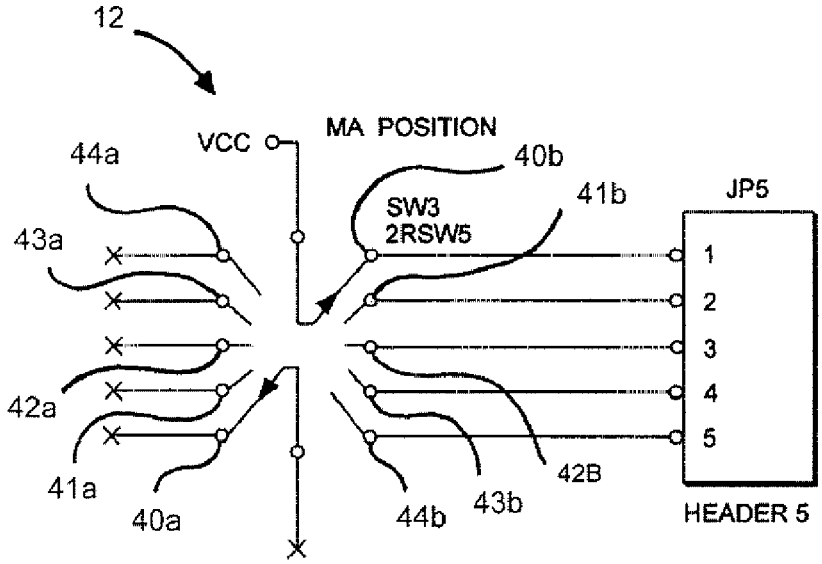
FIG. 4 is an electrical schematic illustrating a current multi-switch used in the radiation device of FIG. 1.

A printer (not shown) may be operatively coupled to the microprocessor 30 for providing a hard copy of the radiation values determined during the radiograph procedure. Additionally, the apparatus 20 may include an interlock circuit that disables the radiographic device when the display 60 is disconnected A method for determining and displaying radiation values is schematically illustrated in FIG. 3 At block 100, apparatus for deter mining and displaying radiation values is operatively coupled to a radiographic device, such as a fluoroscope A plurality of look-up tables is stored into a memory of the apparatus at block 102. As noted above, the look-up tables may provide predicted radiation rates associated with measured current and voltage values. The predicted radiation rates may be based on empirical data. At blocks 104 and 106, measured current and voltage values, respectively, are received via communication ports. A momentary radiation rate is determined and displayed based on the measured current and voltage values with reference to the stored look-up tables at block 108. At block 110, an accumulated radiation dosage is calculated and displayed. The accumulated radiation dosage may be approximated by running a sample loop that obtains the momentary radiation rate and repeating the sample loop after a known time interval. The radiation that accumulates during a given sample loop may be obtained by multiplying the momentary radiation rate by the time interval. The dosages for each sample loop conducted while the x-ray tube is operating are then aggregated to obtain a final accumulated radiation dosage.

While only certain embodiments have been set forth, alternatives and modifications will be apparent from the above description to those skilled in the art. These and other alternatives are considered equivalents and within the spirit and scope of this disclosure and the appended claims.

What is claimed:

1. Apparatus for detecting and displaying x-ray radiation generated by a radiographic device having current and voltage controls, comprising:

a current feedback circuit for obtaining a current level of the radiographic device and generating a current value;

a voltage feedback circuit for obtaining a voltage level of the radiographic device and generating a voltage value;

a microprocessor operatively coupled to the current and voltage feedback circuits to receive the current and voltage values, the microprocessor including a memory, the microprocessor being programmed to generate a dynamic radiation rate based on the current and voltage values; and a display operatively coupled to the microprocessor for displaying the dynamic radiation rate.

2. The apparatus of claim 1, in which a look-up table is stored in the memory, the look-up table including multiple estimated radiation rates, wherein each estimated radiation rate is associated with a given set of current and voltage levels, and wherein the dynamic radiation rate comprises a selected estimated radiation rate having associated current and voltage levels that most closely match the current and voltage values obtained by the current and voltage feedback circuits.

3. The apparatus of claim 1, in which the memory is further programmed to measure a time period during which the radiographic device operates and to approximate an accumulated radiation dosage based on the measured time period and the dynamic radiation rates.

4. The apparatus of claim 2, in which the memory is programmed to repeat a sample loop after a fixed period of time to obtain a periodic dynamic radiation rate and to approximate a radiation dosage for each sample loop.

5. The apparatus of claim 3, in which the memory is programmed to run a plurality of sample loops during a given radiographic procedure, and in which the memory is programmed to aggregate the radiation dosage for all sample loops to obtain a total accumulated radiation dosage.

6. The apparatus of claim 1, in which the current feedback circuit comprises a multi-switch, and in which the current level is inferred from a position of the multi-switch.

7. The apparatus of claim 1, in which the voltage feedback circuit comprises a transformer for directly sensing the voltage level.

8. A method for determining and displaying x-ray radiation generated by a radiographic device having current and voltage controls, comprising:

determining a current value from the current control;

determining a voltage value from the voltage control;

generating a dynamic radiation rate based on the current and voltage values; and displaying the predicted radiation rate.

9. The method of claim 8, in which generating the dynamic radiation rate comprises:

storing in a memory of a microprocessor a look up table including multiple estimated radiation rates, wherein each estimated radiation rate is associated with a given set of current and voltage levels; and selecting an estimated radiation rate having associated current and voltage levels that most closely match the current and voltage values as the dynamic radiation rate.

10. The method of claim 8, in which the current control comprises a multi-position switch, and in which the current value is determined by identifying a position of the multi-position switch.

11. The method of claim 8, in which the voltage value comprises an analog voltage value that is converted to a digital voltage value prior to identifying the predicted radiation rate.

12. The method of claim 8, further comprising calculating an accumulated radiation dosage by measuring a time period during which the dynamic radiation rate applies.

13. The method of claim 12, in which the accumulated radiation dosage is calculated by:

repeating a sample loop after a given time interval, during which a dynamic radiation rate is obtained;

multiplying the dynamic radiation rate by the time interval to obtain a sample loop dosage; and aggregating all sample loop dosages obtained during operation of the radiographic device.

* * * * *